US006077352A

United States Patent [19]

Damrau et al.

[11] Patent Number: 6,077,352

[45] Date of Patent: Jun. 20, 2000

[54] MOUNTING ASSEMBLY FOR A SINGLE BACKING ROLL COATING STATION

[75] Inventors: Wayne A. Damrau, Wisconsin Rapids; Michael A. Mayer, Plover, both of Wis.; Martin Friedrich Kustermann, Heidenheim; Richard Christian Bernert, Giengen, both of Germany

[73] Assignee: Consolidated Papers, Inc., Wisconsin Rapids, Wis.

[21] Appl. No.: 08/707,701

[22] Filed: Sep. 4, 1996

Related U.S. Application Data

[63] Continuation of application No. 08/469,804, Jun. 6, 1995, abandoned, which is a continuation of application No. 07/939,012, Sep. 2, 1992, abandoned.

[51] Int. Cl.[7] ..... B05C 3/12

[52] U.S. Cl. ..... 118/419; 118/413; 118/123

[58] Field of Search ..... 162/135, 199; 118/104, 123, 126, 261, 410, 419, 325, 411, 255, 216, 223, 224, 225, 262, 413

[56] References Cited

U.S. PATENT DOCUMENTS

| | | | |
|---|---|---|---|
| 2,070,667 | 2/1937 | Lougee . | |
| 2,203,273 | 6/1940 | Williams . | |
| 3,418,970 | 12/1968 | Phelps et al. | 118/413 |
| 3,486,482 | 12/1969 | Hunger . | |
| 3,518,964 | 7/1970 | Nagler . | |
| 3,611,987 | 10/1971 | Kohler et al. . | |
| 4,250,211 | 2/1981 | Damra et al. . | |
| 4,310,573 | 1/1982 | Damrau . | |
| 4,473,344 | 9/1984 | Sollich | 118/414 |
| 4,512,279 | 4/1985 | Damrau et al. . | |
| 4,821,672 | 4/1989 | Bruno . | |
| 4,869,933 | 9/1989 | Sollinger et al. . | |
| 4,889,071 | 12/1989 | Fundell . | |
| 4,945,855 | 8/1990 | Eklund et al. . | |
| 4,966,093 | 10/1990 | Sommer . | |
| 5,005,515 | 4/1991 | Sollinger . | |
| 5,021,124 | 6/1991 | Turtinen et al. | 162/199 |
| 5,076,200 | 12/1991 | Mayer et al. . | |
| 5,112,653 | 5/1992 | Damrau et al. . | |
| 5,186,753 | 2/1993 | Nakazawa et al. . | |
| 5,203,920 | 4/1993 | Plomer . | |

FOREIGN PATENT DOCUMENTS

| | | | |
|---|---|---|---|
| 695920 | 10/1964 | Canada | 162/191 |
| 90/06184 | 6/1990 | WIPO | 427/356 |

OTHER PUBLICATIONS

Pulp and Paper Manufacture, vol. II, 1969 M$^c$ Graw–Hill Book Company (New York, NY) pp. 500–504.

*Primary Examiner*—Brenda A. Lamb
*Attorney, Agent, or Firm*—Juettner Pyle & Piontek

[57] ABSTRACT

An assembly having at least three coaters or separate doctor or blade units, all arranged at a single backing roll coating station is provided. At least two of the coater or blade units can be movably positioned for easy operation and servicing of all three units. Additionally, one or more of the coater units may have doctors or blades, and the coater units with blades or blade unit may each be angularly positioned through a range of blade angles to optimize coating operations.

40 Claims, 8 Drawing Sheets

FIG. 6
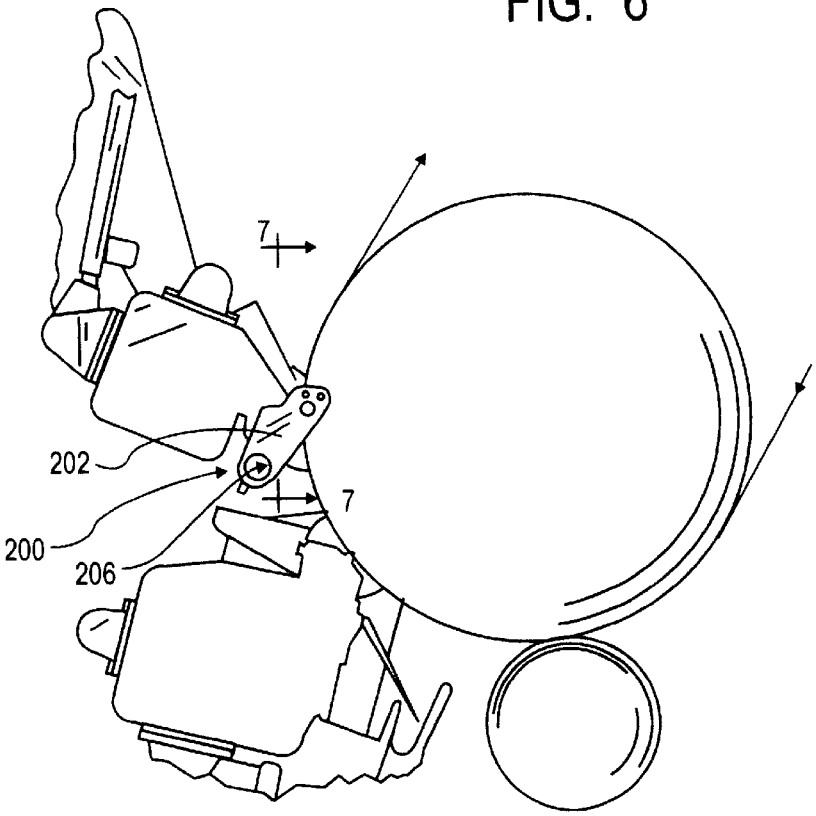
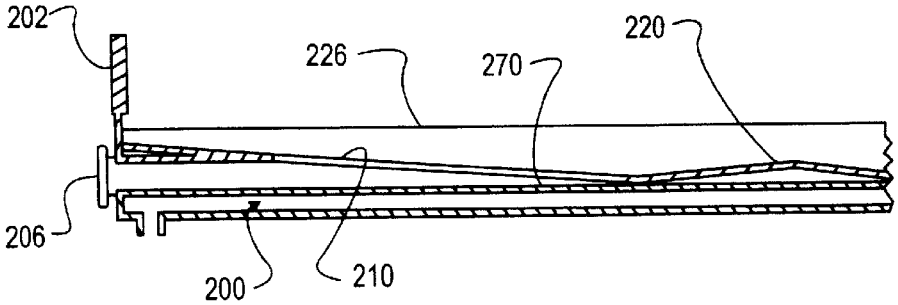
FIG. 7

MOUNTING ASSEMBLY FOR A SINGLE BACKING ROLL COATING STATION

This application is a continuation of application Ser. No. 08/469,804 filed Jun. 6, 1995, now abandoned, which is a continuation of application Ser. No. 07/939,012 filed Sep. 2, 1992, now abandoned.

This invention relates to paper coaters and, more particularly, to a mounting assembly for placing multiple paper coaters about a single backing roll coating station.

BACKGROUND OF THE INVENTION

It is previously known to locate two paper coaters at a coating station around a single back up or backing roll to coat the same side of a moving paper web. For example, in U.S. Pat. Nos. 4,250,211, 4,310,573, or 4,512,279, a dip roll coater unit and a short dwell time applicator (SDTA) or coater unit are mounted about a single backing roll. Additionally, it has been known to locate two coater units on a backing roll with one coater coating one side of the web and the other coater coating the opposite side of the web. Heretofore, it has been unknown to locate three coaters coating the same side of the web about a single backing roll. The physical size of the coaters, the need to place them at certain locations on the backing roll and technical coating requirements have dictated that two or fewer coaters be placed at a coating station about a single backing roll. However, as individual coaters became more complex, such as the coater with an integral and a separate doctor or blade shown in U.S. patent application Ser. No. 375,241, filed Jul. 3, 1989, now abandoned and wherein it is desirable to use such a more complex coater in pairs or with other types of coaters, it becomes very difficult to accommodate even two of them around a single backing roll coating station, while yet permitting efficient operation and proper maintenance of the individual coaters.

While multiple coaters could be accommodated on multiple backing roll coating stations, such an approach is cost prohibitive and from a technical standpoint also prohibited. Many times successive coatings on the same side of the web must be applied by the multiple coaters in a time frame which would not permit the multiple backing roll coating stations approach. For that matter, it is not possible for the coaters to be merely evenly spaced about the web wrapped portion of the circumference of the backing roll, as most coaters for operational reasons can only be used or located in specific positions on the backing roll. For example, generally trailing blade coaters cannot be located in just any quadrant of the backing roll. An inverted blade coater is usually located on one of the lower quadrants of the backing roll. A dip roll coater is usually located near the bottom of the backing roll. Additionally, a paper mill requires a great deal of flexibility in which type coaters will be used, making highly desirable the location of three coater or blade units for coating or blading the same side of the web at a coating station around but a single backing roll.

Another disadvantage in using multiple coaters on a single backing roll is it becomes difficult not only to maintain the coaters, but in fact to even operate them. For example, with modern paper machines and coaters now approaching 33 feet (10.0 meters) in width, referred to as the cross machine direction, it becomes extremely difficult to withdraw coating doctored or bladed off by the coater blade over such a long cross machine distance. As the coatings used can be many times more viscous than water, it would be difficult to remove doctored or bladed off coating using a wide but relatively shallow depth, gravity flow, coating overflow pan. Heretofore, in order to insure the bladed off coating did not spill over a gravity flow, coating overflow pan, it was necessary for the overflow pan to be relatively deep, say eighteen inches (20 cm)or more in depth. The requirement for such a deep pan, itself, can make it difficult, if not impossible, to put two or more coater or blade units around a single backing roll but yet permit the coaters or blade units to be properly adjusted.

Attempts in the past have been made to use an auger to withdraw coating from a coater overflow pan. See U.S. Pat. No. 3,518,964. In that patent the auger was very short, extended in a machine direction, and not a cross machine direction, and operated in a very deep pan. Such pan and auger installation was totally incapable of being used in a multiple coater arrangement, as there is insufficient room, and that installation would not function to remove coating from a pan approximately 33 feet (10.0 meters) wide in an cross machine direction.

Further, in order to build such a wide machine and coater unit, it is also necessary to control and prevent deflection of the coater unit and particularly of any blade or blade unit which must be extremely accurately placed across the entire width of the web, while the coater or blade unit is usually only supported at its widely spaced apart sides or ends.

Because of the great width of coaters, approximately 33 feet (10.0 meters) and getting wider, and the requirement that the coater and doctor or blade positions be accurately controlled, to perhaps as accurate as a few ten thousandths of an inch (several thousandths of a millimeter), it is very difficult to place several coaters and/or blade units on but a single backing roll. Such accuracy requires very rigid and consequently large cross beams to carry the weight of the units, which can be 8 tons or perhaps more. However, the larger the cross beam, the greater the deflection problem becomes due to the increased weight of the cross beam itself. Even a large cross beam would have considerable deflection due solely to the coater or blade unit it carries and the beam's own weight. One approach used to limit the deflection is by pre-stressing the cross beam, itself, to counter the anticipated deflection due to gravity and operational loading. Such a deflection control system is shown in U.S. Pat. Nos. 4,907,528 or 5,005,515.

BRIEF SUMMARY OF THE INVENTION

The mounting assembly of the present invention permits two or more coater or doctor blade units or three coater units to be assembled or mounted at a single backing roll coating station, but yet permits the coater and doctor or blade units to be easily adjusted, operated and maintained. The mounting assembly of the present invention for use on a paper machine, comprises a single backing roll rotatably mounted to the paper machine, at least first and second coater or blade (also doctor) units, first mounting means for locating one of the coater or blade units at a lower portion of the backing roll, and at least second mounting means for locating the other of the coater or blade (or doctor) units at an upper portion of the backing roll, each of said first and second mounting means being pivotable about at least one locus. Said pivot locus for said first mounting is located below the center of said backing roll while said pivot locus for said second mounting means is located above the center of said backing roll. Each of the mounting means pivots its associated coater or blade unit into an operating position and a servicing position which does not interfere with the operating and/or servicing position of the other coater blade units or any other coater unit (a third coater) located at the backing roll. Preferably each of said first and second mounting means is pivotable about two loci, one locus adjacent the paper machine frame to which said mounting means is secured and the other loci being spaced some distance away and adjacent the associated coater or blade unit carried by that mounting means. The double loci construction permits the coater and particularly the doctor or blade units to be pivoted to desired blade angles with respect to the backing roll.

The compactness of the first and second mounting means permits, if desired, three coating applicators or coater units to be located around a single backing roll, such as two SDTA coater units, each having an applicator unit with an integral doctor or blade and a separate doctor or blade unit, and in addition a dip roll coater unit which also may or may not have its own doctor or blade.

In order to place two or three coater or blade units on a single backing roll, some of the overflow pans used on some of the coaters must be and are limited or shallow in depth. Unless the doctored or bladed off coating is closely controlled, there is a good possibility it will spill over the shallow overflow pan and contaminate the web and/or machines, causing coating defects. Additionally, an uncontrolled overflow of any of the overflow pans would make coating station operation and maintenance very difficult, and poor operation or maintenance risks more coating defects. Means to control coating in the one or more necessarily shallow depth overflow pans is provided, and in one embodiment comprises shallow, quarter-point drain pan means to cause controlled gravitational flow. Additionally, the drainage can be assisted by the provision of suction or scavaging pump means to help pull the bladed off coating from the shallow overflow pan means. Alternatively or additionally, auger means extending along the length of the shallow overflow pan means in the cross machine direction, can be used to physically push and pull the coating from one or more of the shallow overflow pan means.

The mounting assembly of the present invention includes a cross beam and means for controlling the deflection of the cross beam and coater or doctor or blade unit thereon which is similar to that shown in U.S. Pat. Nos. 4,907,528 or 5,005,515. Preferably the cross beam and cross beam deflection control means comprise an inner beam portion and an outer beam portion extending in a cross machine direction, said inner and outer beam portions being supported at the ends or sides adjacent the web. Pressure means is provided spaced between the inner and outer cross beam portions which may be selectively pressurized with fluid to control or eliminate the beam's deflection.

It is a primary object of the mounting assembly of the present invention to mount two or more coater or doctor or blade units about a single backing roll in a manner that they can be easily operated and serviced.

Another object of the mounting assembly of the present invention is to mount three coaters about a single backing roll.

Still another object of the mounting assembly of the present invention is to mount two or more coater or blade units on a single backing roll and permit each of the coater or blade units to pivot independently into an operating position and a maintenance or service position.

Yet another object of the mounting assembly of the present invention is to provide shallow overflow pans means workable with two or more wide coater or blade units on a single backing roll.

Still a further object of the mounting assembly of the present invention is to control overflow from wide cross machine direction coater or blade units.

A further object of the mounting assembly of the present invention is to provide means for withdrawing coating from shallow depth, long length (cross machine direction) overflow pans without the coating spilling over the pans.

A still further object of the mounting assembly of the present invention is to limit and control the deflection of two or more coater or blade units placed around a single backing roll.

These and other objects of the present invention will become apparent from the accompanying figures of the drawings and the following written description.

BRIEF DESCRIPTION OF THE DRAWINGS

FIG. 6 is a partial view of a mounting assembly of the present invention having a blade unit with a shallow, quarter-point gravity flow overflow pan means to assist drainage of coating bladed off from the web running on the single backing roll.

FIG. 7 is an enlarged cross-sectional view of the overflow pan shown in FIG. 6, taken along the lines 7—7.

DESCRIPTION OF THE PREFERRED EMBODIMENTS

Figure 1:
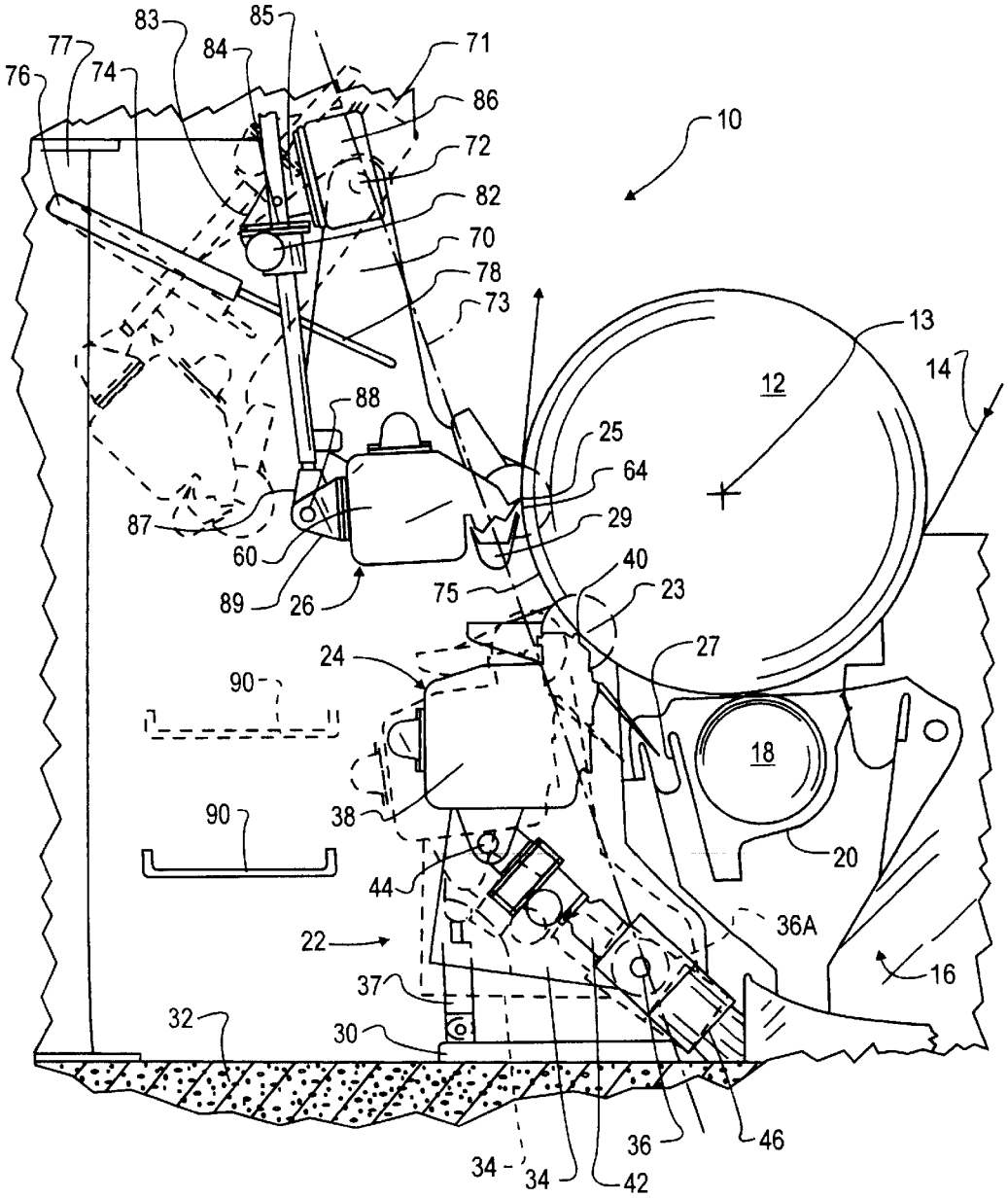
FIG. 1 is an elevational view of a first embodiment of mounting assembly of the present invention for mounting a dip roll coater unit and a short dwell time applicator (SDTA) coater unit which has its own doctor blade and a separate doctor blade unit around a single backing roll to form a coating station, the latter two units being shown in operating positions in full lines and in maintenance or service positions in dashed lines.

Referring to FIG. 1, a first embodiment 10 of the mounting assembly of the present invention is shown. The embodiment 10 as shown is a multiple of coaters located at a coating station located on a single backing roll 12. In this instance the backing roll 12 is considerably larger in diameter than the usual 30 to 40 inches (86 to 92 cm), being 59 inches (about 150 cm) in diameter. However, any roll with a diameter of at least 48 inches (122 cm) may be suitable. The center of the backing roll 12 is indicated at 13 and is mounted in the paper machine frame to rotate about its center as is conventional. A moving paper web 14 is shown on the backing roll. Spaced about the backing roll 12 is a dip roll coater unit 16, having a dip roll 18 rotating in a dip roll pan 20, as is conventional. Generally, the dip roll coater in normal operation is not movable to any significant degree, the exception being the "nip" between the backing roll 12 and the dip roll 18 can be varied. Of course, for maintenance purposes the dip roll 18, itself, is removable.

Operation characteristics of the dip roll coater 16 require it to be placed generally at the bottom of the backing roll so that only the top of the dip roll 18 touches the web on the backing roll, and that excess coating does not spill out of the dip roll pan 20. As the dip roll coater when used in a multiple coater arrangement is usually the first coater, that usually relegates any subsequent coater or doctor blade units to be positioned further down the web and along the periphery of the backing roll, and in the instance of FIG. 1, in what would mathematically be referred to as the third quadrant.

Also on the backing roll 12, is a second coater unit 22, like that described in U.S. patent application Ser. No. 375,241, comprising a short dwell time applicator (SDTA) unit 24 (as disclosed in U.S. Pat. No. 4,250,211), with its integral doctor blade 23 and overflow pan 27 and its separate blade unit 26 with its doctor blade 25 and another overflow pan 29. Thus, the second coater unit 22 has two blades, the first doctor blade 23 being on the applicator unit 24 and the second doctor blade 25, being on the separate doctor or blade unit 26.

The second coater (in FIG. 1, reference numerals 24 and 26) must be placed on the web on the backing roll in a manner that the two doctors or blades 23 and 25 drain by gravity away from 1the web. Such gravity drainage can be accomplished in the FIG. 1 embodiment when the unit 22 is in or near the above referred to mathematical third quadrant. Thus, the general placements of the dip roll coater unit 16, the SDTA unit 24 and the separate blade unit 26 (the latter two units comprising unit 22) are determined by their individual requirements.

In addition, it is desirable that sufficient distance be placed between the three units (16, 24 and 26) to permit their servicing. Of course, the crowding of the three separate units in an area essentially in and/or adjacent the third quadrant of the backing roll, makes achieving ease of operation, maintenance or service very difficult.

Generally, the dip roll coater 16 does not move significantly, for servicing is usually provided simply by giving access to its two cross machine sides. As shown in FIG. 1, service for the upstream web (right) side is relatively easy as that side is unincumbered by adjacent machinery. On the other hand, the downstream (left) side is essentially closed off from access by the SDTA coater 24 when in its operating position. Likewise, the upstream side of the SDTA coater 24 is closed off from access by the dip roll coater 16. In order to provide access to both the dip roll coater 16 and the SDTA coater 24, the SDTA coater is movably mounted so that it can be swung away and down into its service position shown in dashed lines in FIG. 1.

As is shown in FIG. 1, the mounting means for the SDTA coater 24 is carried on a base 30 secured to the paper machine floor or frame 32. Pivoted to this base are large side arms 34 which carry the SDTA coater. The lower pivot point or locus for the side arms 34 is indicated a point 36. A cross shaft 36A connects the side arms 34. The side arms 34 and the cross shaft 36A for the coater 24 are connected to one or more hydraulic cylinders 37 which also are connected to the base 30. Operation of the hydraulic cylinder 37 can pivot the side arms 34 and cross shaft 36A about the point 36 (in FIG. 1 located a distance below and a small distance to the left of the center 13 of the backing roll) to raise or lower the coater unit 24 between one of its operating (solid lines) and service (dashed lines) positions. Of course, the mounting means could utilize mechanical devices or pneumatic devices or cylinders, instead of hydraulic cylinders 37.

Additionally the SDTA unit 24 comprises a large cross-section cross beam 38 which, in fact, carries the actual coating application or applying portion and blade across the width of the web 14. This cross beam 38 is generally similar to that shown in FIG. 10, but somewhat larger in cross section, in this instance 22×26 inches (approximately 56 cm×66 cm) in cross-section. The cross beam 38, itself is pivotally mounted to the upper portion of the side arms 34 about a locus or point indicated at 40 which coincides with the line established by the tip of the blade 23 touching the circumference of the backing roll.

Figure 2:
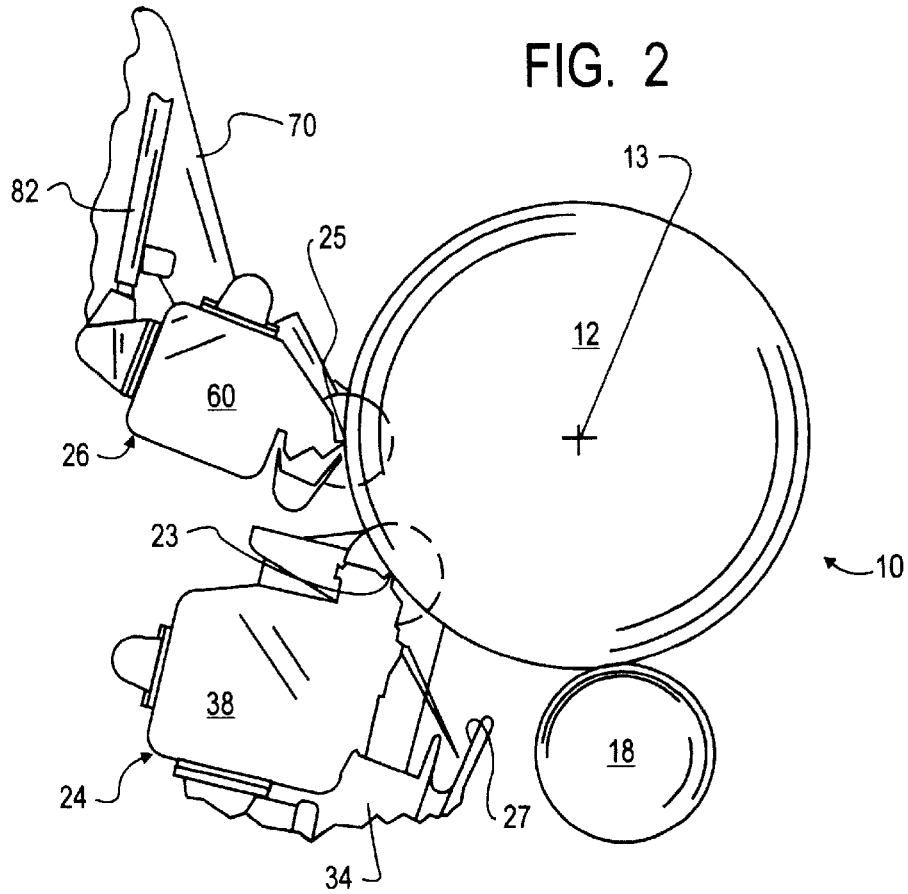
FIG. 2 shows the coater unit and separate doctor blade unit in FIG. 1 in one of their pivoted blade angle operating positions.
Figure 3:
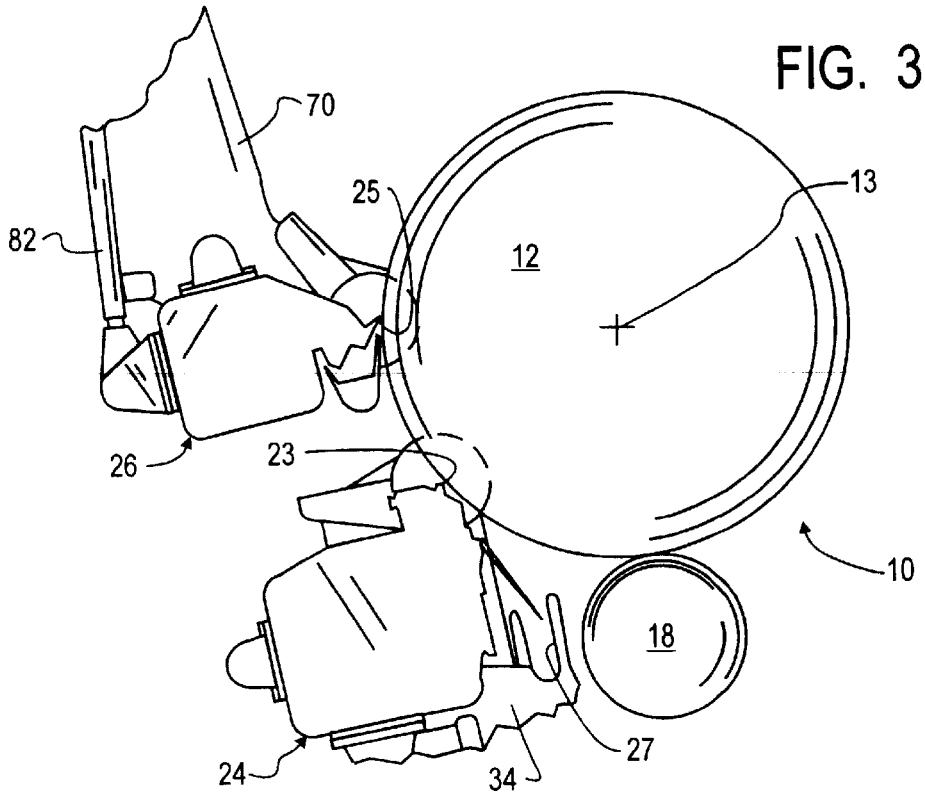
FIG. 3 shows the coater unit and separate doctor blade unit in FIG. 1 in another of their pivoted blade angle operating positions.

The operating envelope required by the SDTA unit 24 also must include sufficient space to permit angular movement of that coater to adjust blade angle, making it even more difficult to locate two or more or three coaters in what is essentially one (the third) quadrant of the backing roll. The coater 24 can, when in its operating position, also be pivoted about the upper pivot point 40 to vary the operating angle the doctor blade 23 of the SDTA 24 makes with the web on the backing roll. In order to pivot the SDTA coater 24 to a desired blade angle, an electrically operated screw jack 42 is provided. The screw jack 42 has its upper end pivotally mounted to the coater 24, schematically indicated at 44, and its lower end pivotally mounted to the cross shaft 36A, schematically indicated at 46. The screw jack 42 is, preferably, operable from the paper machine's control or operator's console and can be lengthened or shortened to increase or decrease blade angle. Two of the various doctor blade angles for the SDTA 24 can be seen in FIGS. 2 and 3, and in this instance the angle of the blade to the web can be varied about 30°, anywhere between 25° to 55°. To achieve such doctor blade angle range may require the unit on which the blade is mounted to have angular movement of up to 70°. This is because in order to achieve a desired blade angle, the unit may have to be moved a greater amount to compensate for blade deflection. This construction, of course, requires a greater envelope of space for each unit. Thus, not only can the position of the coater unit 24 be varied to permit service of the coater unit 24 or of the dip roll coater unit 16, the coater unit 24 can also be varied for operation at different blade angles.

Figure 10:
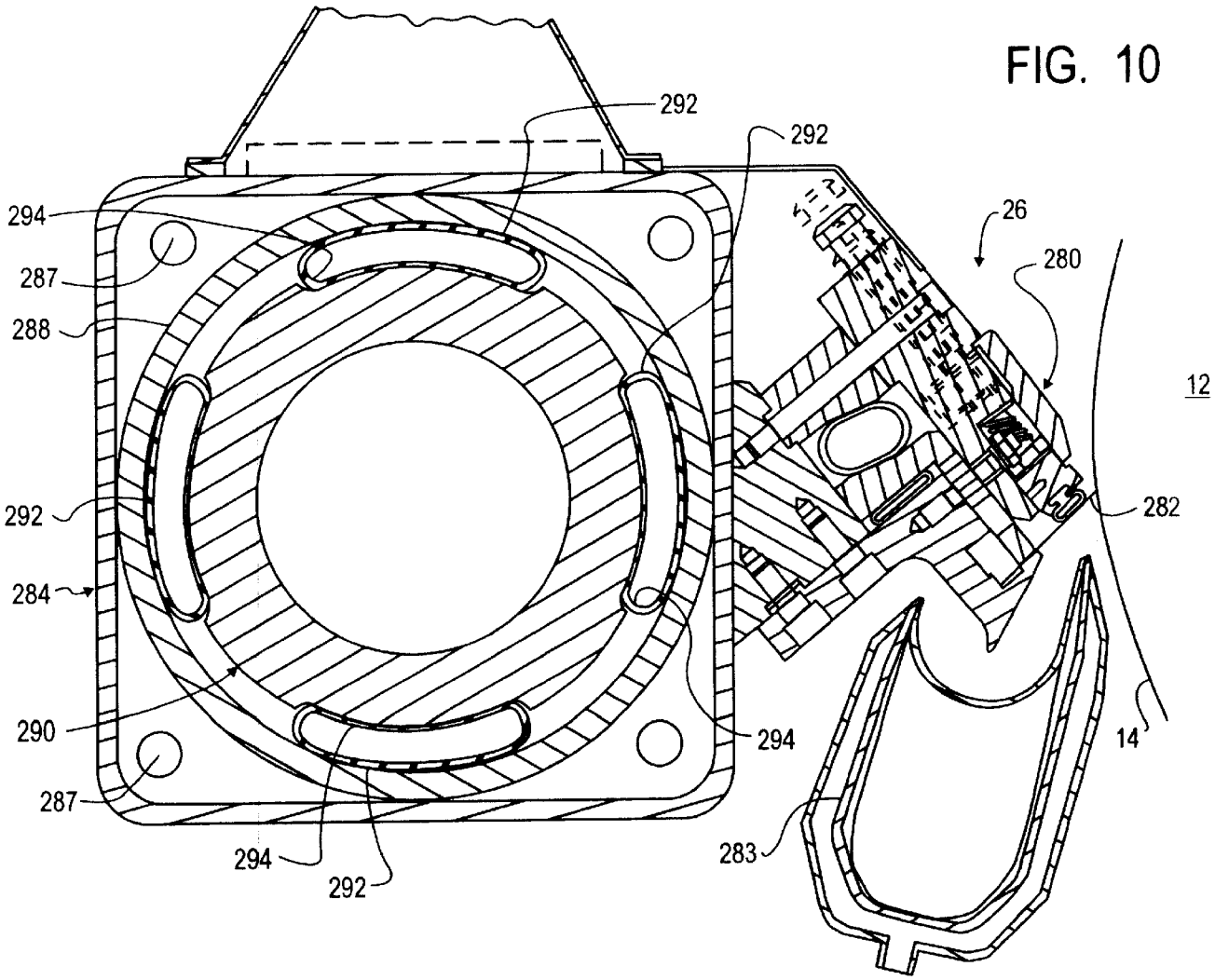
FIG. 10 is a cross-sectional view of a cross beam deflection control means for use with any of the embodiments of the present invention shown in the other figures.

Referring to the separate doctor blade unit 26 (FIG. 1), it is similar in construction to the coater unit 24 in that it is carried on the large cross beam 60 (more fully shown in FIG. 10). As the blade unit 26 is somewhat smaller in size and lighter in weight, its cross beam is smaller, being approximately 20×20 inches (approximately 51 cm×51 cm) in cross-section. The blade unit 26 too is similarly mounted to permit placement of that unit in an operating position (solid lines) and service position (dashed lines). Again, to support the unit 26, two large upper side arms 70 are mounted to and suspended from the paper machine frame 71 to pivot about a locus or point indicated at 72 (in FIG. 1, located above and to the left of the center 13 of the backing roll). The location of the pivot point 36 for the first or coater unit 24 and the pivot point 72 of the second or blade unit 26 is such that a straight line 73 drawn between these two points lies outside the backing roll circumference or perimeter 75. The blade unit 26 is movable between its operating position (solid lines) and maintenance or service position (dashed lines) by an upper hydraulic cylinder 74 which has one or upper end 76 pivotally connected to the paper machine frame 77 and the other or lower end 78 pivotally connected to the upper side arms 70. Of course, a mechanical means such as screw jacks or a fluid or pneumatic devices or cylinders could be utilized instead of hydraulic cylinders 74. If desired, the cylinder 74 (hydraulic or pneumatic or other fluid) or mechanical equivalent could have two strokes, a long stroke to move the unit 26 to a service position and a shorter stroke for use in the operating position. Referring to FIG. 1, the doctor blade unit 26, at each side is pivotably mounted about an axis 64 on the side arms 70. When in the operating position the side arms 70 locate the axis or line 64 (seen as a point in FIG. 1, but in reality a line) and the tip of the blade 25 generally on the circumference of the backing roll. Thus, the blade unit 26 too can pivot about the axis 64 to adjust the angle of the blade 25. Again, when in the operating position the unit 26 can be moved to vary the blade angle, say anywhere between 5° to 55°; or the blade could also be of the bent blade type.

A large electrically operated screw jack 82, similar to screw jack 42 previously described, is provided. To help stabilize and support the two sides or ends of the blade unit 26 and guide the same for parallel movement, an upper cross shaft 86 of a smaller cross section than the beam 60, is provided. The screw jack 82 has the upper end bracket 83 pivoted at 84 to the bracket 85 on the cross shaft 86 and the lower end 87 pivoted at 88 to bracket 89 on the cross beam 60 of the unit 26. Again, varying the length of the screw jack 82 alters the blade angle.

In addition, to help service both the coater unit 24 and doctor blade unit 26, a movable workmen's platform 90 is provided, shown in the solid lines positioned to service the lower coater unit 24 and in the dashed lines positioned to service the upper blade unit 26. The platform 90 can be moved by any conventional means, such as but not limited to hydraulic or pneumatic cylinders or donuts or scissor jacks.

Thus, each of the units 24 and 26 can be moved into a service position or operating position; when in the service positions the units are at least ten feet apart to permit service; when in the operating position the blade angles of the doctor blade 23 or 25 to the web can be, likewise, varied between 0° and 55° and/or a bent blade used as desired, all while permitting use and/or service of the dip roll coater unit 16 which is located on the same single backing roll 12, forming a very versatile coating station. The operation of the various coater units 16 and/or 24 and/or the doctor blade unit 26 is well known in the prior art, such as from U.S. Pat. Nos. 4,250,211, 4,310,573 or 4,512,279 or U.S. patent application Ser. No. 375,241.

Figure 4:
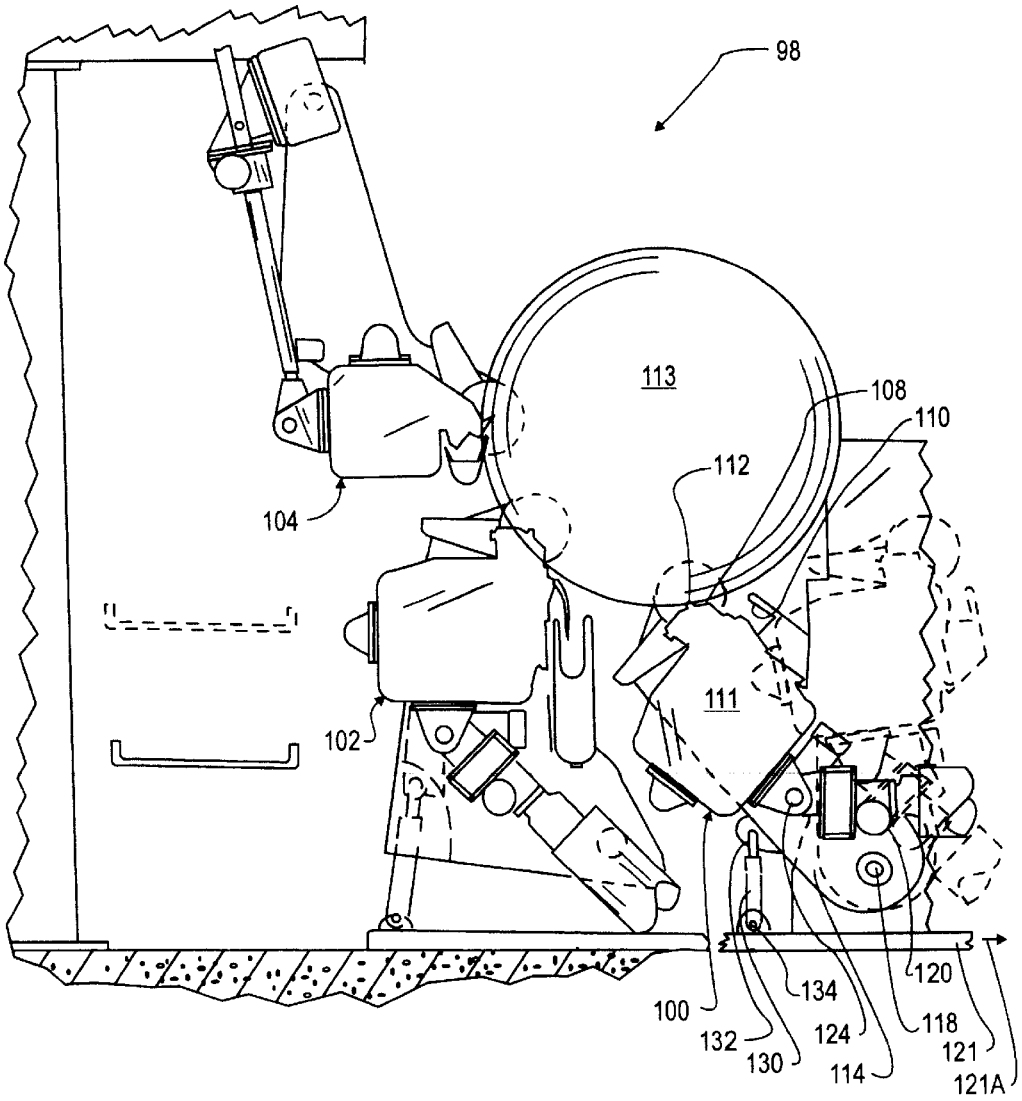
FIG. 4 shows a second embodiment of mounting assembly of the present invention showing two SDTA coater units each having its own doctor blade and a separate doctor blade unit, all mounted around a single backing roll.

Referring to FIG. 4, an embodiment 98 generally similar to that in FIG. 1 is shown, the difference being the dip roll coater unit 16 of FIG. 1 is replaced by another (earlier on the web) SDTA coater unit 100. As the trailing or second SDTA unit 102 and the trailing blade unit 104 are similar to those units 24 and 26 shown in FIG. 2, they will not be further described.

As to the now first coater unit 100 on the web, it has a doctor or blade 108 or any other means for metering (smooth or profiled rod) and an overflow pan 110 and is also generally similar to the coater unit 24, previously described. The coater unit 100 has a cross beam 111 which carries the coating applicator or applying portion, and itself is pivotal about an axis, locus or point 112 (which is the line of contact of the tip of the doctor blade 108 with the circumference of the backing roll 113) on side arms 114. The side arms 114, in turn, pivoted at their lower ends with respect to the paper machine about a locus or axis 118. Thus like coater 24, coater 100 can be pivoted to adjust blade angle about the locus or axis 112 or about the locus or axis 118 to move the coater 100 into or out of a service position. To facilitate the former movement, a screw jack 120 is provided, the lower or right end of the screw jack being pivot mounted to a cross shaft (similar to 36A or 86 of FIG. 1) and the upper or left end being pivot mounted to the cross beam 111 at the locus or axis 124. To facilitate the latter movement, a hydraulic or pneumatic cylinder 130 is provided, the cylinder at its upper end being pivotally mounted to the side arms, as indicated at the locus 132, and being pivotally mounted at its lower end to the paper machine, as indicated at the locus 134.

Preferably, the entire of the coater unit 110 is slidably mounted on the base 121 so that the entire coater 100 can be first moved to the right (as indicated by the arrow 121A) about 2.5 feet (0.75 meters) for servicing of either the first or second coater units on the web. Such slidable construction is well known in the papermachinery field and need not be further described. After the coater 100 has been slid to the right (not shown), then the coater 100 can be swung or pivoted clockwise (as shown in dotted lines) about the axis 118 to a service position so that the upstream side of the coater 102 and/or the coater 100 can be maintained.

Figure 5:
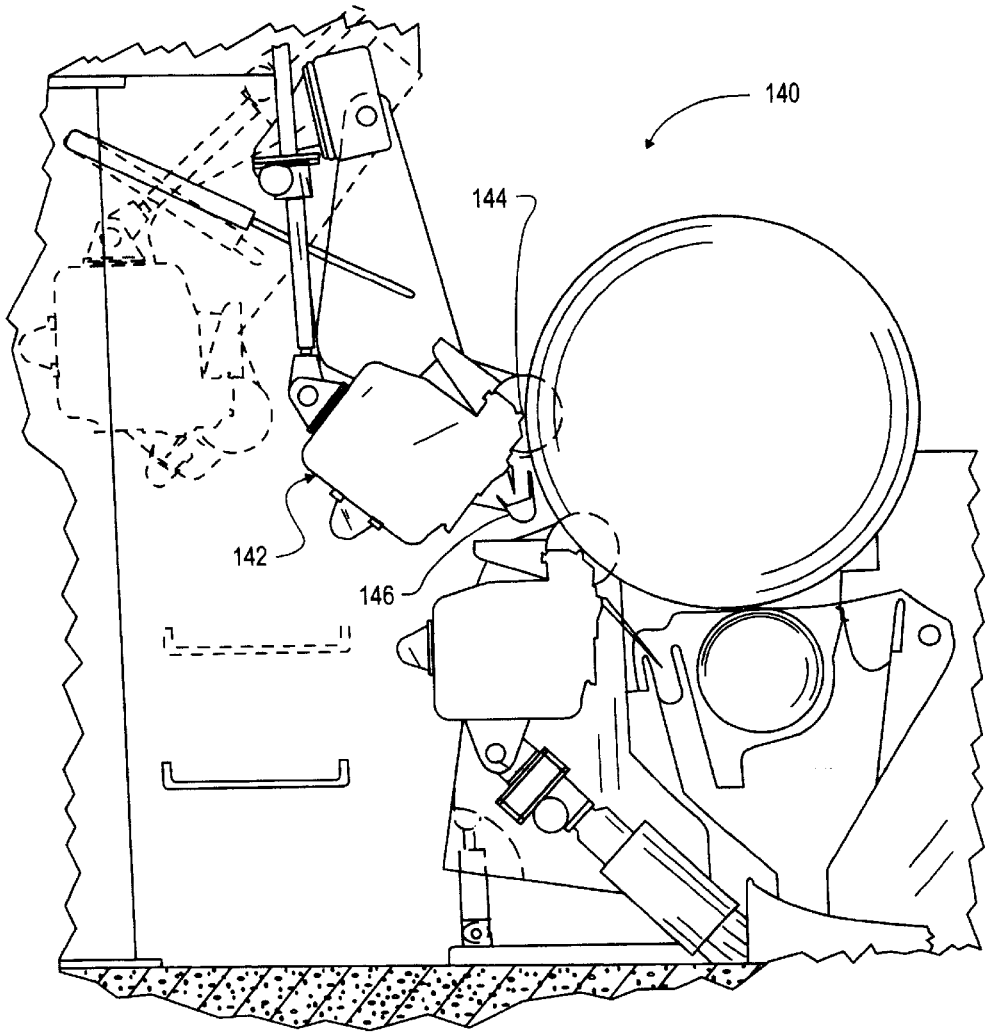
FIG. 5 shows a third embodiment of mounting assembly of the present invention showing a dip roll coater unit and two SDTA coater units mounted around a single backing roll.

Referring to FIG. 5, an embodiment 140 is shown and is generally similar to that shown in FIG. 1, except a second short dwell coater unit 142 is located and used on the backing roll, instead of the doctor blade unit 26. The coater unit 142 has a doctor or blade 144 and a coater overflow pan 146 which are generally similar to those of the separate blade unit 26 of FIG. 1. In other respects the installation is similar to that of FIG. 1 and need not be further described to a person skilled in the art, it being known to such person to use the second SDTA coater unit 142 in a manner similar to that described in U.S. patent application Ser. No. 375,241.

As FIG. 5 shows a dip roll coater unit and two separate SDTA coater units all on one backing roll, should it be desired, it would be possible to apply three individual coatings to the same side of the web, or any of the various combinations could be used such as, but not limited to: (1) the dip roll and one SDTA, (2) the dip roll, one SDTA and the separate doctor or blade (of the second SDTA), or (3) the dip roll, the doctor or blade of the first SDTA and the second SDTA, giving a wide variety of coating operations and techniques that could be performed at this three coater—one backing roll coating station.

While there is generally sufficient room for the dip roll coater unit 16 and SDTA coater unit 24, 100 or 102 to have reasonably deep overflow pans 20, 27 or 110, there is not sufficient room to provide a deep enough overflow pan for doctor or blade unit 26 or coater unit 104 or 142 to handle the overflow from its doctor or blade removing coating off of a web 15 feet, 25 feet, or even greater width, without a considerable risk of spilling. Referring to FIGS. 6 and 7, a shallow, or limited depth, 12 to 15 inches (30 to 38 cm) overflow pan 200 can be provided for use with the blade unit 26 or coater units 104 or 142. The pan 200 can be mounted to its associated unit by the side brackets 202 (only one being shown). Preferably the overflow pan would be of conventional double wall construction to permit the circulation of chilled water to prevent premature coagulation of coating in the pan. This pan 200 has two take off points 206 (only one being shown) for removal of the bladed off coating from the pan, one at each side of the pan. The inlets 210 (elongated slots (shown) or multiple holes) to the take off points 206 are located at about the quarter-points of the length of the pan. Thus, for a pan of a length (cross machine direction) of 25 feet, each tak point would drain about one half the length of the pan (12.5 feet) and would be located about one quarter the length (6.25 feet) from each side. To facilitate the flow of the coating into this quarter take off point, the pan floor 220 on either side of the inlet for about one quarter of the length would be sloped or tapered (Say a 1:12 to 1:8 taper) to the quarter-point inlet. Of course, the other side of the pan (not shown in FIG. 7) would be a mirror image of what is shown. By providing the pan of such construction, the tendency for the doctored or bladed off coating to overflow the top 226 of the overflow pan is minimized. If need be, as will be described in conjunction with FIG. 11, the coating can be suctioned from the take off points 206 by suction pump means, which will greatly increase the capacity of the pan to handle doctored or bladed off coating as compared to merely relying upon gravity flow from the overflow pan into the coating system.

Figure 8:
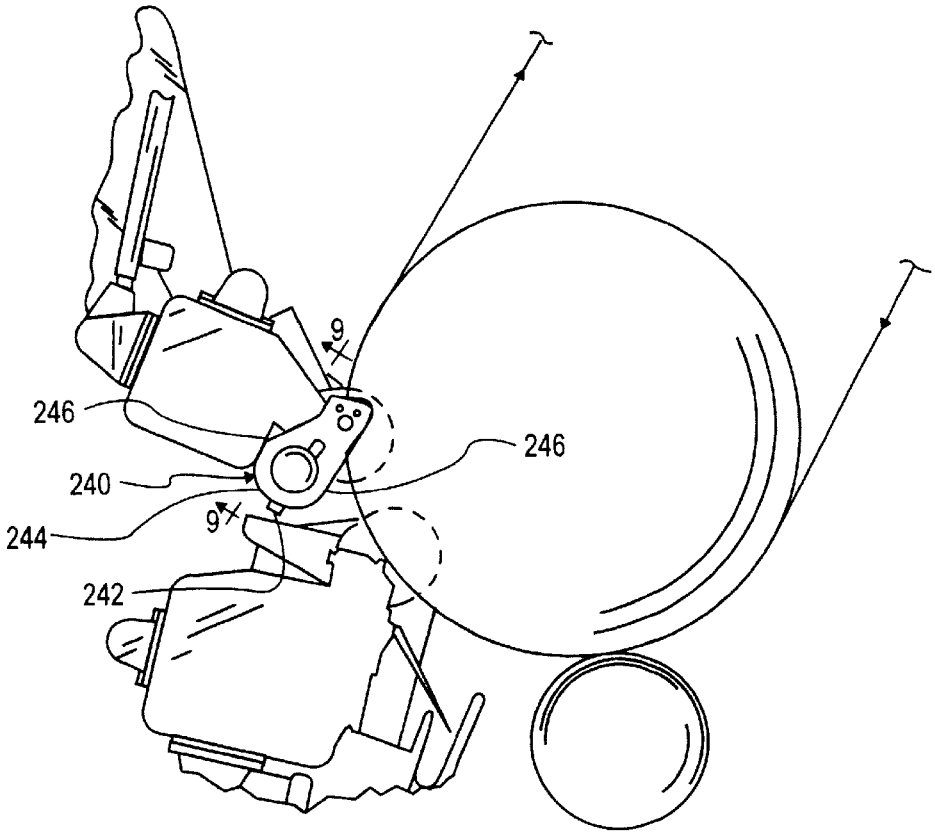
FIG. 8 is a partial view of a mounting assembly of the present invention having a shallow, auger assisted overflow pan to assist drainage of coating bladed off from the web on the single backing roll.
Figure 9:
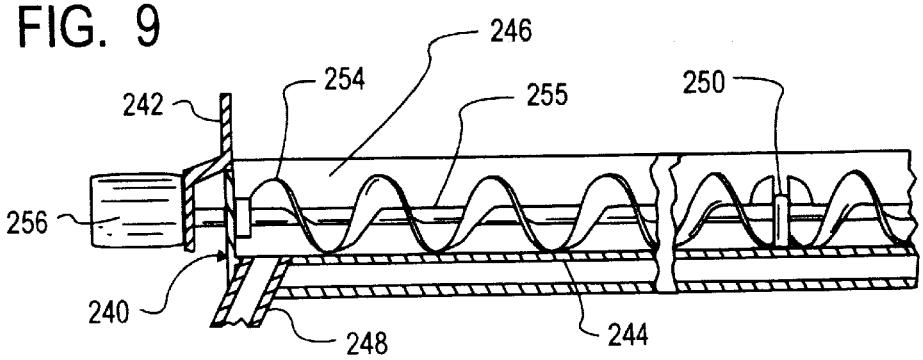
FIG. 9 is an enlarged cross-sectional view of the auger overflow pan shown in FIG. 8, taken along the lines 9—9.

While relatively low viscosity bladed off coating may be handled with a quarter point pan with or without pump suction, there may be situations where more is necessary to remove the coating without overflowing or spilling the pan. Referring to FIGS. 8 and 9, auger overflow pan means 240 is shown. This pan too is shallow in depth (12 or 15 inches or less) and preferably of a double wall construction. The pan has end walls 242, closed by a curved bottom wall 244 and two side walls 246. The bottom 244 has an outlet 248 for draining off the excess coating doctored or bladed off at each side. Inside the pan an inner bearing stand 250 is provided near the center of the pan. An auger 254 extending in the cross machine direction has a shaft 255 that is rotatably mounted in the bearing stand 250 and in a bearing mounted on the end wall 242. The shaft 255 of the auger 254 is driven by a motor means or gear motor depicted at 256. Rotation of the motor 256 turns the shaft 255 and auger 254 to pull bladed off coating from the center of the pan toward the end outlets 248, and then pushes the doctored or bladed off coating into the outlets 248. Generally in a 25 foot or wider pan the auger would extend say 27 ft (about 110% of the cross machine length of the pan). The other end of the pan would have a similar auger installation or structure. The auger could be continuous from side to side or two shorter augers extending from each end toward the center could be used. In the latter case two motors would be needed, while in the former case one or two motors would be used. While this pan is shown with the doctor or blade unit 26, it could also be used with any of the coater units 104 or 142.

Referring to FIG. 10, in order to minimize the cross section for placement around a single backing roll and or to limit or eliminate deflection of the coaters or blade units, all the cross beams mentioned above are of a structure similar to that shown for the doctor blade unit 26. As is shown, the unit 26 has a doctor or blade 282 which rides on the web 14 on the roll 12. Beneath the blade is an overflow pan 283. The blade is mounted to the outside of a generally square tube or beam 284 which extends across the width of the web between the side arms. Inside the rectangular beam 284 is an outer circular tube 288, the outside of which is generally tangent to the inside of the square tube 284. Inside this tube 288, is a smaller diameter but thicker inner tube 290. Both the ends of the inner and outer tubes 284 and 288 are secured to the inner tube 290. As is shown pressure means in the form of a plurality of hoses or bladders 292 are provided and may be selectively supplied with fluid, such as hydraulic oil, or preferably compressed air under pressure from a source (not shown). The tubes 288 or 290 are contoured as indicated at 294 to provide a cavity to receive the bladders. The four bladders at 90° spacing on the circumference between the tubes 288 and 290 may be selectively pressurized to limit or eliminate beam deflection and consequently coater head and doctor or blade deflection due to weight or operational loading. For a more specific disclosure of the operation of this deflecting limiting means see U.S. Pat. Nos. 4,907,528 or 5,005,515.

Figure 11:
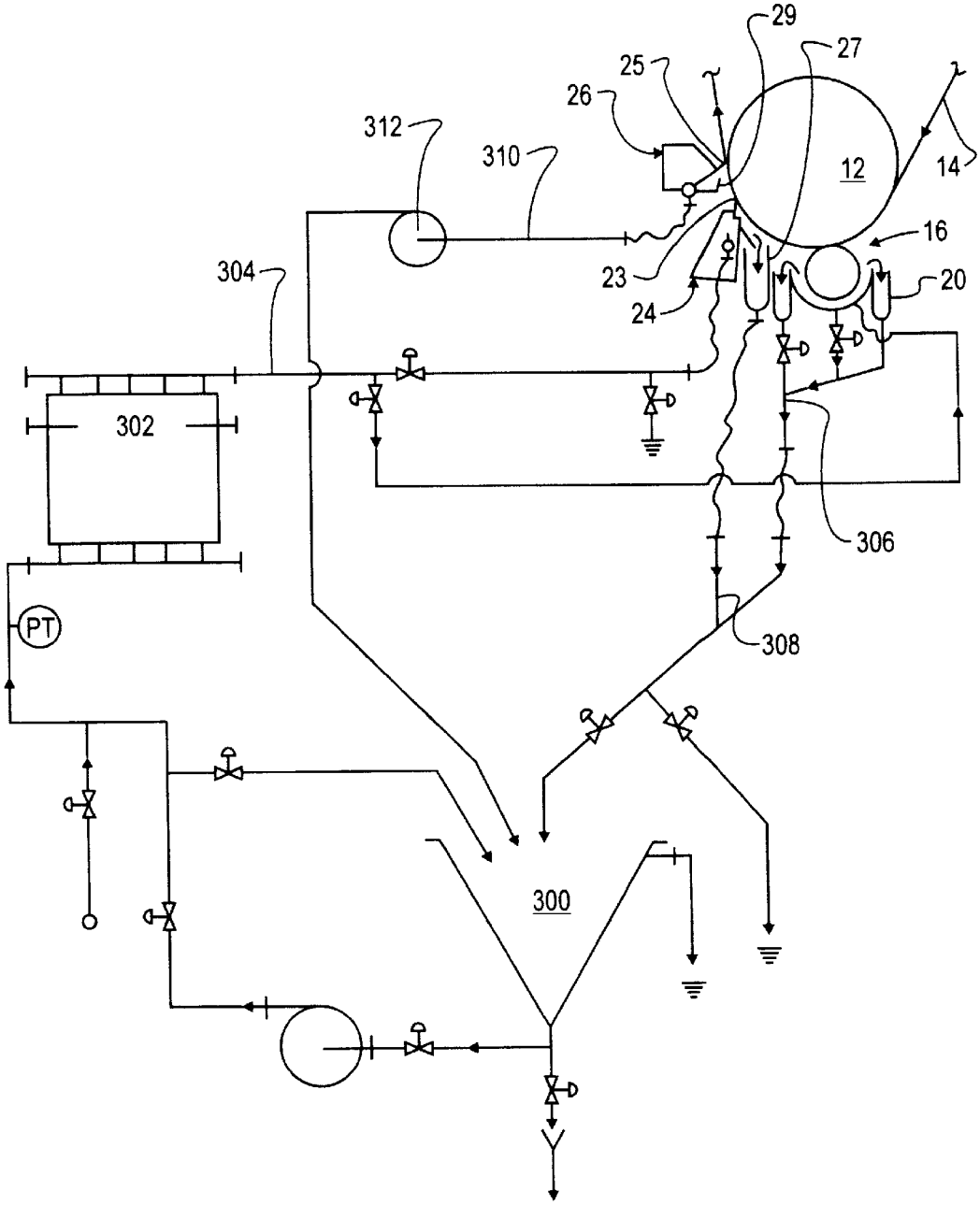
FIG. 11 is a schematic diagram of one form of coating flow system for use with the present invention.

Referring to FIG. 11, the coating supply system for the multiple coater unit arrangement of FIG. 1 is shown. The coating can be supplied from the coating supply tank 300, through a filter 302 to a pipe 304 and from there to the dip roll coater unit 16 and an SDTA coater unit 24. The coating can be doctored or bladed off by either doctor or blade 23 or 25 or both doctors or blades 23 and 25. This doctored or bladed off coating is caught in coater pan 20 or overflow pans 27 or 29. From there the coating can be collected in pipes 306, 308 or 310 and reprocessed and returned to the supply tank 300 to be reused as is conventional. As shown the pipe 310 draining the doctor or blade unit 26 overflow pan 29 may be, preferably connected to a positive displacement pump 312 to help withdraw or suck coating from the shallow overflow pan 29. A similar pump arrangement can also be provided for overflow pans 200 (FIG. 6) or 240 (FIG. 8).

While normally the web would be moving from the first doctor blade or coater unit to the second doctor blade or coater unit, in some circumstances the numerical notation may not necessarily give an indication of web direction. While the above mentioned overflow pans were described with wider webs, they could also be useful with coater or blade units for the web at least 100 inches (approximately 2.5 m) in width.

While the invention is described in conjunction with a paper machine, that term as used herein and in the claims includes papermaking machines, board machines and coating machines, such as off line coaters.

It should be understood that in locations where one of the hydraulic cylinder or device, a mechanical jack or device or a pneumatic cylinder or device is shown, any of the others devices just mentioned could, as is well known in engineering, be substituted. Likewise, these devices, wherever desired, could be of the double stroke type, just like as is discussed for cylinder 74.

It should be further understood that while blade angles of between 0° to 55° are preferable, other angles could be used and/or a bent blade used.

It should be again understood, wherein a blade was described for doctoring coating, other known types of doctor devices such as smooth or profiled rods or metering bars could be utilized. As used in the specification and claims the term doctor is understood to include all types of coating doctoring or smoothing devices including such blades, rods and bars.

While the preferred embodiments of multiple coaters single backing roll station mounting assembly of the present invention have been illustrated and described, from the foregoing it should be understood that variations, modifications and equivalent structures thereof fall within the scope of the appended claims.

What is claimed is:

1. A mounting assembly for mounting at a single coating station on a paper machine having a moving paper web with both a desired amount and an excess amount of coating thereon, the mounting assembly comprising a single web backing roll having a center of rotation and an outer roll surface supporting the moving paper web, a first coated web trailing angle doctor mounted to ride on the paper web on said backing roll and spaced away from said outer roll surface by at least said paper web for removing at least some of the excess coating from off of said paper web, said first coated web doctor not contacting said outer roll surface, means for mounting said first coated web doctor to move between a first position with said first coated web doctor essentially in contact with the coating on the paper web on said backing roll for removing at least some of the excess coating on said web from said web and a second position down and away from said backing roll with said first coated web doctor essentially out of contact with and spaced away from the paper web on said backing roll, said means for mounting said first coated web doctor being mounted on said paper machine and pivoting between its first and second positions, said means for mounting said first coated web doctor pivoting about a point below said center of rotation of said backing roll, a second coated web trailing angle doctor spaced away from and above said first coated web doctor and mounted to ride on the web on said backing roll and spaced away from said roll outer surface by at least said paper web, said second coated web doctor not contacting said outer roll surface for removing any remaining excess coating on said web from off of said paper web, and means for mounting said second coated web doctor to move between a first position with said second coated web doctor essentially in contact with the coating on the paper web on the backing roll for removing any remaining excess coating from said web and a second position up and away from said backing roll, with said second coated web doctor essentially out of contact with and spaced away from the web on said backing roll, said means for mounting said second coated web doctor being mounted on said paper machine and pivoting between its first and second positions, said means for mounting said second coated web doctor pivoting about a point above said center of rotation of said backing roll, said means for mounting said first coated web doctor and said means for mounting said second coated web doctor being movable independently with respect to each other, said first and second coated web doctor blades being spaced away from said outer roll surface by the web and not touching said outer roll surface when in said first positions, said first and second coated web doctors not touching said outer roll surface when in said second positions, said first and second coated web doctors being at trailing angles to the paper web of between 0 degrees to 55 degrees for permitting removal of coating, whereby said first coated web doctor and said second coated web doctor may be moved to said first positions for removing all of the excess coating from the paper web and leaving the desired amount of coating on the paper web and to said second positions for maintenance.

2. An assembly as in claim 1, wherein said pivot points for said means for mounting said first coated web doctor and said means for mounting said second coated web doctor lie on a line, said line lying entirely outside the outer surface circumference of said backing roll, whereby said first coated web doctor and second coated web doctor may be moved between the first and second positions without interference.

3. An assembly as in claim 1, further comprising a cross beam extending in a cross machine direction substantially the length of said backing roll and carrying said first coated web doctor, said cross beam having means for compensating for deflection of said cross beam due to gravitational and operational force exerted upon said cross beam and first coated web doctor, whereby said cross beam maybe of a smaller cross section size to facilitate placement around said backing roll than were it without said means for compensating for deflection.

4. An assembly as in claim 3, wherein said cross beam further comprises an inner portion, an outer portion and pressure means between said inner and outer portions, said pressure means being adapted to be pressurized to compensate for deflection of said cross beam.

5. An assembly as in claim 4, wherein said pressure means comprises four bladder means spaced between the perimeter of said inner portion and said outer portion of said cross beam.

6. An assembly as in claim 3, further comprising a second cross beam extending in a cross machine direction the length of said backing roll and carrying said second coated web doctor, said second cross beam having means for compensating for deflection of said second coated web doctor due to gravitational and operational forces exerted upon said second coated web doctor and second cross beam, whereby said second cross beam may be of a cross section to facilitate placement around said backing roll.

7. An assembly as in claim 6, wherein said second cross beam further comprises an inner portion, an outer portion and pressure means between said inner and outer portions, said pressure means being adapted to be pressurized to compensate for deflection of said second cross beam.

8. An assembly as in claim 7, wherein said pressure means comprises four bladders spaced about the perimeter of said inner portion and said outer portion of said second cross beam.

9. An assembly as in claim 1, wherein said second position of said means for mounting said first coated web doctor and said second position of said means for mounting said second coated web doctor are spaced apart at least ten feet to permit service of said first coated web doctor and second coated web doctor.

10. An assembly as in claim 1, further comprising overflow means for removing coating taken off by said first coated web doctor, said overflow means for removing coating being carried by said means for mounting said first coated web doctor.

11. An assembly as in claim 10, further comprising overflow means for removing coating taken off by said second coated web doctor, said overflow means removing coating taken off by said second coated web doctor being carried by said means for mounting said second coated web doctor.

12. An assembly as in claim 1, further comprising shallow overflow pan means for removing coating taken off by said second coated web doctor, said overflow pan means for removing coating having a depth of less than fifteen inches and being carried by said means for mounting said second coated web doctor.

13. An assembly as in claim 1, further comprising a movable workmen's platform on the side of said first coated web doctor and second coated web doctor opposite said backing roll, said movable workmen's platform being positionable into a first position to service said first coated web doctor and a second position to service said second coated web doctor.

14. An assembly as in claim 1, wherein said backing roll has a diameter of at least 48 inches.

15. A mounting assembly for mounting at a single coating station on a paper machine having a moving web with both the desired and excess amount of coating thereon, comprises a single backing roll having a center of rotation and supporting the moving paper web, a first doctor mounted to ride on the web on said backing roll for removing at least some of the excess coating, means for mounting said first doctor to move between a first position with said first doctor essentially in contact with the coating on the web on said backing roll for removing at least some of the excess coating and a second position down and away from said backing roll with said first doctor essentially out of contact with the web on said backing roll, said means for mounting said first doctor being mounted on said paper machine and pivoting between its first and second positions, said means for mounting said first doctor pivoting about a point below said center of rotation of said backing roll, a second doctor spaced away from and above said first doctor for removing any remaining excess coating, and means for mounting said second doctor to move between a first position with said second doctor essentially in contact with the coating on the web on the backing roll for removing any remaining excess coating and a second position up and away from said backing roll, with second doctor essentially out of contact with the web on said backing roll, said means for mounting said second doctor being mounted on said paper machine and pivoting between its first and second position, said means for mounting said second doctor pivoting about a point above said center of rotation of said backing roll, said means for mounting said first doctor and said means for mounting said second doctor being movable independently with respect to each other, further comprising a coating applicator on said backing roll for applying at least some of said excess coating to the web, said coating applicator being located on said backing roll before said second doctor in relationship to the direction of web movement, whereby said first doctor and second doctor may be moved to said first positions for removing all of the excess coating from the paper web leaving the desired amount of coating on the paper web and to said second positions for maintenance.

16. A mounting assembly for mounting at a single coating station on a paper machine having a moving web with coating thereon, comprises a single backing roll having a center of rotation and adapted to support the moving paper web, a first doctor mounted to ride on the web on said backing roll, means for mounting said first doctor to move between a first position with said first doctor essentially in contact with the web on said backing roll and a second position down and away from said backing roll with said first doctor essentially out of contact with the web on said backing roll, said means for mounting said first doctor pivoting between its first and second positions, said means for mounting said first doctor pivoting about a point below said center of rotation of said backing roll, a second doctor spaced away from and above said first doctor, and means for mounting said second doctor to move between a first position with said second doctor essentially in contact with the web on the backing roll and a second position up and away from said backing roll, with said second doctor essentially out of contact with the web on said backing roll, said means for mounting said second doctor pivoting between its first and second positions, said means for mounting said second doctor pivoting about a point above said center of rotation of said backing roll, a coating applicator on said backing roll for applying said coating to the web, said coating applicator being located on said backing roll before said second doctor in relationship to the direction of web movement, said coating applicator being located on said backing roll before said first doctor, whereby said first doctor and second doctor may be moved to said first positions for removing coating from the paper web and to said second positions for maintenance.

17. An assembly as in claim 16, wherein said coating applicator is a short dwell time applicator.

18. An assembly for coating paper as in claim 16, wherein said backing roll is at least 100 inches in width and supports a moving paper web at least of 100 inches in width in a cross machine direction, said applicator is at least 100 inches in width for applying coating liquid to substantially the entire width of the web, at least one of said doctors being at least 100 inches in width for removing excess coating applied to the web, an open top coating pan at least 100 inches in width and being open to atmosphere at the top to receive the excess coating removed by at least one of said doctors, and means for positively removing the excess coating removed from the web by at least one of said doctors, said means for positively removing the excess coating comprises auger means extending at least 100 inches in a cross-machine direction, said auger means extending parallel to said backing roll and said applicator and being mounted at the bottom of said open top coating pan, whereby at least one of said doctors can operate unhampered by excess coating.

19. An assembly as in claim 18, wherein said applicator comprises a short dwell time applicator coater carrying said first doctor, and said means for positively removing excess coating operates on the coating flowing off of said first doctor of said short dwell time applicator.

20. An assembly as in claim 19, further comprising second means for positively removing excess coating from said second doctor.

21. An assembly as in claim 20, wherein said second means for positively removing excess coating is suction pump means.

22. An assembly as in claim 20, wherein said second means for positively removing excess coating is second auger means.

23. An assembly for coating paper as in claim 16, wherein said backing roll supporting said moving paper web is at least of 100 inches in width in a cross machine direction, a coating liquid supply tank, a first pump for supplying coating liquid from said supply tank, said applicator being supplied with coating liquid by said first pump from said supply tank and for applying coating liquid to substantially the entire width of the web, at least one of said doctors removing excess coating applied to the web, and means for positively removing the excess coating removed from the web by at least one of said doctors, said means for positively removing the excess coating comprising suction pump means for withdrawing the excess coating in a cross-machine direction, whereby at least one of said doctors can operate unhampered by excess coating, said suction pump means returning said withdrawn coating liquid to said coating liquid supply tank, said supply tank being open so that said first pump and said suction means pump may operate.

24. A mounting assembly for mounting at a single coating station on a paper machine having a moving web with both the desired and excess amount of coating thereon, comprises a single backing roll having a center of rotation and supporting the moving paper web, a first doctor mounted to ride on the web on said backing roll for removing at least some of the excess coating, means for mounting said first doctor to move between a first position with said first doctor essentially in contact with the coating on the web on said backing roll for removing at least some of the excess coating and a second position down and away from said backing roll with said first doctor essentially out of contact with the web on said backing roll, said means for mounting said first doctor being mounted on said paper machine and pivoting between its first and second positions, said means for mounting said first doctor pivoting about a point below said center of rotation of said backing roll, a second doctor spaced away from and above said first doctor for removing any remaining excess coating, and means for mounting said second doctor to move between a first position with said second doctor essentially in contact with the coating on the web on the backing roll for removing any remaining excess coating and a second position up and away from said backing roll, with said second doctor essentially out of contact with the web on said backing roll, said means for mounting said second doctor being mounted on said paper machine and pivoting between its first and second positions, said means for mounting said second doctor pivoting about a point above said center of rotation of said backing roll, said means for mounting said first doctor and said means for mounting said second doctor being movable independently with respect to each other, further comprising a short dwell time applicator for applying at least some of said coating to the web, said first doctor being part of and mounted on said short dwell time application, whereby said first doctor and second doctor may be moved to said first positions for removing all of the excess coating from the paper web leaving the desired amount of coating on the paper web and to said second positions for maintenance.

25. A mounting assembly for mounting at a single coating station on a paper machine having a moving web with coating thereon, comprises a single backing roll having a center of rotation and adapted to support the moving paper web, a first doctor mounted to ride on the web on said backing roll, means for mounting said first doctor to move between a first position with said first doctor essentially in contact with the web on said backing roll and a second position down and away from said backing roll with said first doctor essentially out of contact with the web on said backing roll, said means for mounting said first doctor pivoting between its first and second positions, said means for mounting said first doctor pivoting about a point below said center of rotation of said backing roll, a second doctor spaced away from and above said first doctor, means for mounting said second doctor to move between a first position with said second doctor essentially in contact with the web on the backing roll and a second position up and away from said backing roll, with said second doctor essentially out of contact with the web on said backing roll, said means for mounting said second doctor pivoting between its first and second positions, said means for mounting said second doctor pivoting about a point above said center of rotation of said backing roll, and overflow pan means for removing coating taken off by said first doctor, said overflow pan means for removing coating being carried by said means for mounting said first doctor, said overflow pan means for removing coating further comprising auger means extending in a cross machine direction whereby said first doctor and second doctor may be moved to said first positions for removing coating from the paper web and to said second positions for maintenance.

26. A mounting assembly for mounting at a single coating station on a paper machine having a moving web with excess coating thereon, comprises a single backing roll having a center of rotation and supporting the moving paper web, a first doctor mounted to ride on the web on said backing roll for removing some of the excess coating, means for mounting said first doctor to move between a first position with said first doctor essentially in contact with the web on said backing roll for removing some of the excess coating and a second position down and away from said backing roll with said first doctor essentially out of contact with the web on said backing roll, said means for mounting said first doctor pivoting between its first and second positions, said means for mounting said first doctor pivoting about a point below said center of rotation of said backing roll, a second doctor spaced away from and above said first doctor for removing the remainder of the excess coating, and means for mounting said second doctor to move between a first position with said second doctor essentially in contact with the web on the backing roll for removing the remainder of the excess coating and a second position up and away from said backing roll, with said second doctor essentially out of contact with the web on said backing roll, said means for mounting said second doctor pivoting between its first and second positions, said means for mounting said second doctor pivoting about a point above said center of rotation of said backing roll and overflow means for removing coating taken off by said first doctor, said overflow means for removing coating being carried by said means for mounting said first doctor, said overflow pan means for removing coating taken off by said first doctor includes pump means, whereby said first doctor and second doctor may be moved to said first positions for removing coating from the paper web and to said second positions for maintenance.

27. A mounting assembly for mounting at a single coating station on a paper machine having a moving web with excess coating thereon, comprises a single backing roll having a center of rotation and supporting the moving paper web, a first doctor mounted to ride on the web on said backing roll for removing some of the excess coating, means for mounting said first doctor to move between a first position with said first doctor essentially in contact with the web on said backing roll for removing some of the excess coating and a second position down and away from said backing roll with said first doctor essentially out of contact with the web on said backing roll, said means for mounting said first doctor pivoting between its first and second positions, said means for mounting said first doctor pivoting about a point below said center of rotation of said backing roll, a second doctor spaced away from and above said first doctor for removing the remainder of the excess coating, and means for mounting said second doctor to move between a first position with said second doctor essentially in contact with the web on the backing roll for removing the remainder of the excess coating and a second position up and away from said backing roll, with said second doctor essentially out of contact with the web on said backing roll, said means for mounting said second doctor pivoting between its first and second positions, said means for mounting said second doctor pivoting about a point above said center of rotation of said backing roll, overflow means for removing coating taken off by said first doctor, said overflow means for removing coating being carried by said means for mounting said first doctor, and overflow pan means for removing coating taken off by said second doctor, said overflow pan means for removing coating taken off by said second doctor being carried by said means for mounting said second doctor, said overflow pan means for removing coating taken off by said second doctor including auger means, whereby said first doctor and second doctor may be moved to said first positions for removing coating from the paper web and to said second positions for maintenance.

28. A mounting assembly for mounting at a single coating station on a paper machine having a moving web with excess coating thereon, comprises a single backing roll having a center of rotation and supporting the moving paper web, a first doctor mounted to ride on the web on said backing roll for removing some of the excess coating, means for mounting said first doctor to move between a first position with said first doctor essentially in contact with the web on said backing roll for removing some of the excess coating and a second position down and away from said backing roll with said first doctor essentially out of contact with the web on said backing roll, said means for mounting said first doctor pivoting between its first and second positions, said means for mounting said first doctor pivoting about a point below said center of rotation of said backing roll, a second doctor spaced away from and above said first doctor for removing the remainder of the excess coating, and means for mounting said second doctor to move between a first position with said second doctor essentially in contact with the web on the backing roll for removing the remainder of the excess coating and a second position up and away from said backing roll, with said second doctor essentially out of contact with the web on said backing roll, said means for mounting said second doctor pivoting between its first and second positions, said means for mounting said second doctor pivoting about a point above said center of rotation of said backing roll, and overflow means for removing coating taken off by said first doctor, said overflow means for removing coating being carried by said means for mounting said first doctor, overflow pan means for removing coating taken off by said second doctor, said overflow pan means for removing coating taken off by said second doctor being carried by said means for mounting said second doctor, said overflow pan means for removing coating taken off by said second doctor including pump means, whereby said first doctor and second doctor may be moved to said first positions for removing coating from the paper web and to said second positions for maintenance.

29. A mounting assembly for mounting at a single coating station on a paper machine having a moving web with excess coating thereon, comprises a single backing roll having a center of rotation and supporting the moving paper web, a first doctor mounted to ride on the web on said backing roll for removing some of the excess coating, means for mounting said first doctor to move between a first position with said first doctor essentially in contact with the web on said backing roll for removing some of the excess coating and a second position down and away from said backing roll with said first doctor essentially out of contact with the web on said backing roll, said means for mounting said first doctor pivoting between its first and second positions, said means for mounting said first doctor pivoting about a point below said center of rotation of said backing roll, a second doctor spaced away from and above said first doctor for removing the remainder of the excess coating, and means for mounting said second doctor to move between a first position with said second doctor essentially in contact with the web on the backing roll for removing the remainder of the excess coating and a second position up and away from said backing roll, with said second doctor essentially out of contact with the web on said backing roll, said means for mounting said second doctor pivoting between its first and second positions, said means for mounting said second doctor pivoting about a point above said center of rotation of said backing roll, and overflow means for removing coating taken off by said first doctor, said overflow means for removing coating being carried by said means for mounting said first doctor, shallow overflow pan means for removing coating taken off by said second doctor, said shallow overflow pan means for removing coating having a depth of less than fifteen inches and being carried by said means for mounting said second doctor, said shallow overflow pan means for removing coating taken off by said second doctor including auger means, whereby said first doctor and second doctor may be moved to said first positions for removing coating from the paper web and to said second positions for maintenance.

30. A mounting assembly for mounting at a single coating station on a paper machine having a moving web with excess coating thereon, comprises a single backing roll having a center of rotation and supporting the moving paper web, a first doctor mounted to ride on the web on said backing roll for removing some of the excess coating, means for mounting said first doctor to move between a first position with said first doctor essentially in contact with the web on said backing roll for removing some of the excess coating and a second position down and away from said backing roll with said first doctor essentially out of contact with the web on said backing roll, said means for mounting said first doctor pivoting between its first and second positions, said means for mounting said first doctor pivoting about a point below said center of rotation of said backing roll, a second doctor spaced away from and above said first doctor for removing the remainder of the excess coating, and means for mounting said second doctor to move between a first position with said second doctor essentially in contact with the web on the backing roll for removing the remainder of the excess coating and a second position up and away from said backing roll, with said second doctor essentially out of contact with the web on said backing roll, said means for mounting said second doctor pivoting between its first and second positions, said means for mounting said second doctor pivoting about a point above said center of rotation of said backing roll, and overflow means for removing coating taken off by said first doctor, said overflow means for removing coating being carried by said means for mounting said first doctor, shallow overflow pan means for removing coating taken off by said second doctor, said shallow overflow pan means for removing coating having a depth of less than fifteen inches and being carried by said means for mounting said second doctor, said shallow overflow pan means for removing coating taken off by said second doctor further comprises pump means, whereby said first doctor and second doctor may be moved to said first positions for removing coating from the paper web and to said second positions for maintenance.

31. A mounting assembly for mounting at a single coating station on a paper machine having a moving web with excess coating thereon, comprises a single backing roll having a center of rotation and supporting the moving paper web, a first doctor mounted to ride on the web on said backing roll for removing some of the excess coating, means for mounting said first doctor to move between a first position with said first doctor essentially in contact with the web on said backing roll for removing some of the excess coating and a second position down and away from said backing roll with said first doctor essentially out of contact with the web on said backing roll, said means for mounting said first doctor pivoting between its first and second positions, said means for mounting said first doctor pivoting about a point below said center of rotation of said backing roll, a second doctor spaced away from and above said first doctor for removing the remainder of the excess coating, and means for mounting said second doctor to move between a first position with said second doctor essentially in contact with the web on the backing roll for removing the remainder of the excess coating and a second position up and away from said backing roll, with said second doctor essentially out of contact with the web on said backing roll, said means for mounting said second doctor pivoting between its first and second positions, said means for mounting said second doctor pivoting about a point above said center of rotation of said backing roll, a coater mounted on the backing roll before said first doctor and second doctor for applying at least some of the said excess coating to the web, wherein at least some of said excess coating can be applied with said coater and at least some removed with one of said first doctor and second doctor, whereby said first doctor and second doctor may be moved to said first positions for removing coating from the paper web and to said second positions for maintenance.

32. A mounting assembly for mounting at a single coating station on a paper machine having a moving web with excess coating thereon, comprises a single backing roll having a center of rotation and supporting the moving paper web, a first doctor mounted to ride on the web on said backing roll for removing some of the excess coating, means for mounting said first doctor to move between a first position with said first doctor essentially in contact with the web on said backing roll for removing some of the excess coating and a second position down and away from said backing roll with said first doctor essentially out of contact with the web on said backing roll, said means for mounting said first doctor pivoting between its first and second positions, said means for mounting said first doctor pivoting about a point below said center of rotation of said backing roll, a second doctor spaced away from and above said first doctor for removing the remainder of the excess coating, and means for mounting said second doctor to move between a first position with said second doctor essentially in contact with the web on the backing roll for removing the remainder of the excess coating and a second position up and away from said backing roll, with said second doctor essentially out of contact with the web on said backing roll, said means for mounting said second doctor pivoting between its first and second positions, said means for mounting said second doctor pivoting about a point above said center of rotation of said backing roll, a short dwell time applicator for applying said coating to the web, said first doctor being part of and mounted on said short dwell time application, and an additional coater mounted on the backing roll before said short dwell time applicator, whereby said first doctor and second doctor may be moved to said first positions for removing coating from the paper web and to said second positions for maintenance.

33. A mounting assembly for mounting at a single coating station on a paper machine having a moving web with coating thereon, comprises a single backing roll having a center of rotation and adapted to support the moving paper web, a first doctor mounted to ride on the web on said backing roll, means for mounting said first doctor to move between a first position with said first doctor essentially in contact with the web on said backing roll and a second position down and away from said backing roll with said first doctor essentially out of contact with the web on said backing roll, said means for mounting said first doctor pivoting between its first and second positions, said means for mounting said first doctor pivoting about a point below said center of rotation of said backing roll, a second doctor spaced away from and above said first doctor, means for mounting said second doctor to move between a first position with said second doctor essentially in contact with the web on the backing roll and a second position up and away from said backing roll, with said second doctor essentially out of contact with the web on said backing roll, said means for mounting said second doctor pivoting between its first and second positions, said means for mounting said second doctor pivoting about a point above said center of rotation of said backing roll, and a shallow overflow pan of a depth of no more than 15 inches having at least two outlets, whereby said first doctor and second doctor may be moved to said first positions for removing coating from the paper web and to said second positions for maintenance.

34. An assembly as in claim 33, wherein said shallow overflow pan has a tapered bottom and said outlets are located at quarter points to withdraw coating from said quarter-points.

35. An assembly as in claim 34, wherein said shallow overflow pan has a depth of no more than 12 inches.

36. An assembly as in claim 33, further comprising suction pump means for withdrawing coating from said overflow pan.

37. An assembly as in claim 33, further comprising auger means in said overflow pan extending in a cross machine direction.

38. A mounting assembly for locating at least two coaters at a paper machine coating station, comprises a single backing roll having a center, a first coater and second coater, first mounting means for locating said first coater at a lower portion of the backing roll, and at least second mounting means for locating said second coater at a higher portion of said backing roll, said first and second mounting means being secured to said paper machine, each of said first and second mounting means being pivotable about at least one locus, said pivot locus for said first mounting means being located below the center of said backing roll, and said pivot locus for said second mounting means being located above the center of said backing roll, each of the at least two mounting means pivoting its associated coater into an operating position and a servicing position.

39. A mounting assembly as in claim 38, wherein each of said first and second mounting means is pivotable about two loci, one locus adjacent the paper machine to which said mounting means is secured and the other loci adjacent the associated coater carried on the mounting means, whereby said two loci construction permits said coaters to be pivoted to desired operating angles with respect to the backing roll.

40. A mounting assembly as in claim 38, further comprising three coaters arranged on said backing roll, whereby any of said three coaters may be used at said single backing roll of the coating station.

* * * * *

UNITED STATES PATENT AND TRADEMARK OFFICE

CERTIFICATE OF CORRECTION

PATENT NO. : 6,077,352
DATED : June 20, 2000
INVENTOR(S) : Damrau et al.

It is certified that error appears in the above-identified patent and that said Letters Patent is hereby corrected as shown below:

Column 11,
Line 47, "doctor" should be -- doctors -- and delete "blades"

Column 13,
Line 24, after "with" insert -- said --

Column 16,
Line 20, after "and" insert -- , -- and after "overflow" insert -- pan --
Line 21, after "overflow" insert -- pan --

Column 19,
Line 44, "application" should be -- applicator --

Signed and Sealed this

Twelfth Day of March, 2002

*Attest:*

*Attesting Officer*

JAMES E. ROGAN
*Director of the United States Patent and Trademark Office*